United States Patent [19]

Takabatake et al.

[11] 4,358,901

[45] Nov. 16, 1982

[54] MULTIPURPOSE BASIC APPARATUS FOR TREATING POWDERS

[75] Inventors: Hikaru Takabatake, Yokohama; Yoshiro Shudo, Tokyo, both of Japan

[73] Assignee: Yamato Kagaku Kabushiki Kaisha, Tokyo, Japan

[21] Appl. No.: 183,830

[22] Filed: Sep. 3, 1980

[30] Foreign Application Priority Data

Mar. 21, 1980 [JP] Japan ..... 55/35857

[51] Int. Cl.[3] ..... F26B 17/10

[52] U.S. Cl. ..... 34/57 R; 34/57 A; 34/91; 34/219; 34/243 R

[58] Field of Search ..... 34/10, 57 R, 57 A, 91, 34/212, 219, 243 R; 432/15, 58; 110/245

[56] References Cited

U.S. PATENT DOCUMENTS 4,153,427 5/1979 Bissett et al. ..... 34/57 A

FOREIGN PATENT DOCUMENTS 51-72768 6/1976 Japan .

*Primary Examiner*—Larry I. Schwartz

*Attorney, Agent, or Firm*—Koda & Androlia

[57] ABSTRACT

A multipurpose basic apparatus for treating powders which is applicable to various powder treatments including spray drying, fluidized bed drying and granulation and fluidized bed continuous drying, which apparatus comprises a lower frame provided with a piping having two openings facing upward, an upper frame provided with two openings facing downward which are respectively positioned in coaxially alined relation to the above mentioned two openings of the lower piping, a feed pump for a sample and a feed pipe for pressurized air, and a lift for moving the upper frame up and down, the apparatus being designed in such a manner that either one or two of a fluidizing chamber, a filter chamber, and a spray drying chamber can be connected between one opening of the lower piping and the corresponding opening of the upper piping, and the other openings of the upper and lower pipings can be provided with one or more of a heater, an aspirator, and a cyclone.

4 Claims, 4 Drawing Figures

MULTIPURPOSE BASIC APPARATUS FOR TREATING POWDERS

BACKGROUND OF THE INVENTION

The present invention relates to a novel multipurpose basic apparatus for treating powders. More particularly, the invention relates to a compact, fundamental, multipurpose basic apparatus for treating powders which is applicable to various powder treatments such as spray drying, fluidized bed drying and granulation and fluidized bed continuous drying.

Spray drying comprises instantaneously drying liquid materials such as solutions and suspensions by atomizing them. This method is advantageous in that the material to be dried is not subjected to a high temperature which causes the properties of the material to be modified by heat, in that condensation, filtration and separation processes can be omitted, and in that the material can be dried within a short period of time. Accordingly, spray drying has been put to practical use in various drug and food industries.

Fluidized bed drying and granulation comprises drying wet powder and granulating the dried powder by using a fluidized bed. Fluidized bed drying may be carried out by a batchwise or continuous process. In this method, the granules to be dried or the mass thereof are dried while being maintained in a dynamic suspended state by the action of hot air. This method is advantageous in that uniform drying can be achieved within a short period of time at a relatively low temperature. Further, the fluidized bed granulation comprises spraying a solution containing a binder onto particles in fluidized state to agglomerate them into granules. This method is advantageous in that it produces a higher yield than other granulating methods, in that the degree of contamination is less, and in that the operational time is shorter.

In the case where these powder treatments are carried out on a small scale for a purpose such as experimental research, production of a small quantity of product, or pilot plant tests, it is desirable that a small-scale apparatus be used. However, compact small-scale apparatuses suitable for carrying out these tests are scarce. Accordingly, when the above mentioned tests are conducted by using conventional apparatuses, the installation thereof requires an excessively large space, and the cost of the experimental materials becomes high. Furthermore, a long period of time is required for testing.

In order to overcome the above described problems, Japanese Patent Laid-open No. 72768/1976, for example, proposes a compact spray drying apparatus. However, this apparatus is applicable only to spray drying. That is, if other powder treatments, particularly those which are based on different principles, are to be carried out, different treating apparatus are required, which inevitably results in an increase in the cost and space for installation.

SUMMARY OF THE INVENTION It is an object of the present invention to provide a multipurpose basic apparatus for treating powders which is applicable to the above mentioned small-scale powder treatments by attaching or detaching a number of accessory attachments to or from a single apparatus.

In accordance with the present invention, the above object can be achieved by a multipurpose basic apparatus for treating powders which is applicable to various powder treatments including spray drying, fluidized bed drying and granulation and fluidized bed continuous drying, which apparatus comprises a lower frame provided with a piping having two openings facing upward, an upper frame provided with two openings facing downward which are respectively positioned in coaxially aligned relation to the above mentioned two openings of the lower piping, a feed pump for a sample and a feed pipe for pressurized air, and a lift for moving the upper frame up and down, the apparatus being designed in such a manner that either one or two of a fluidizing chamber, a filter chamber and a spray drying chamber can be connected between one opening of the lower piping and the corresponding opening of the upper piping and the other openings of the upper and lower pipings can be provided with one or more of a heater, an aspirator and a cyclone.

DETAILED DESCRIPTION OF THE INVENTION

Figure 1:
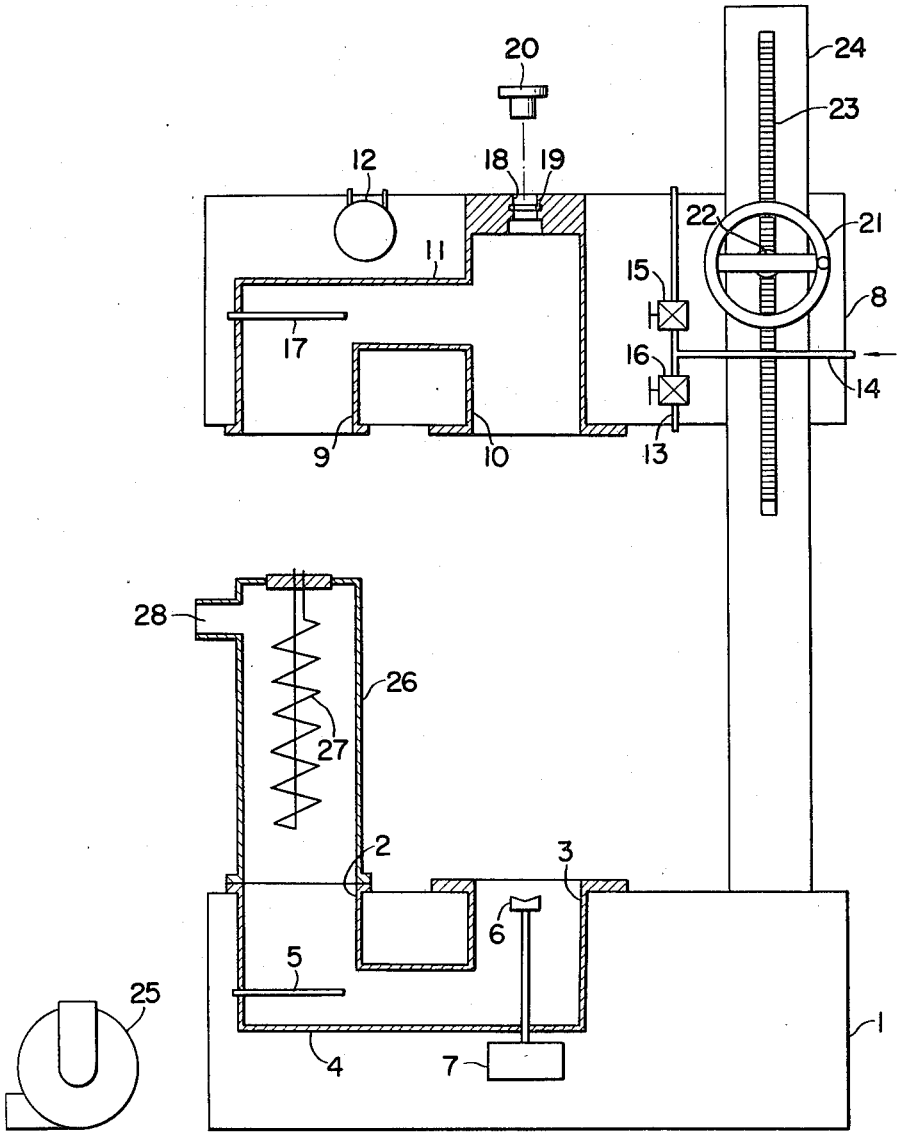
FIG. 1 is an elevation, partly in vertical section and partly in schematiic form, of one example of a basic apparatus embodying the present invention.

Referring first to FIG. 1, the apparatus according to this invention illustrated therein has a lower frame 1 in the form of a hollow rectangular parallelepiped of a suitable size. The lower frame 1 accommodates therewithin a lower piping 4 provided with two openings 2 and 3 facing upward. The openings 2 and 3 may be of any size and shape, and may have any suitable distance therebetween. Ordinarily, however, they are of circular shape of the same size. Likewise, the piping may be of any length and depth. The piping 4 is provided therewithin with a lower thermosensor 5 on the side of the opening 2 and a stirring motor clutch 6 in the vicinity of the opening 3. The stirring motor clutch 6 is rotated by a stirring motor 7. The openings 2 and 3 of the lower piping 4 are adapted to be connectable to various accessory attachments as described hereinafter, as in the case of openings of an upper piping as described hereinbelow.

A column 24 is rigidly fixed at its lower end to the lower frame 1 at one end thereof and extends vertically upward therefrom. An upper frame 8 is supported at one end thereof by this column 24 as described hereinafter.

The upper frame 8 is of a size and shape corresponding to those of the lower frame 1 and accommodates therewithin an upper piping 11 provided with two openings 9 and 10 facing downward. The openings 9 and 10 of the upper frame 8 are positioned in corresponding coaxial relation to two openings 2 and 3, respectively, of the lower frame 1 in the vertical direction and have the same size and shape as those of the respective openings 2 and 3.

Figure 4:
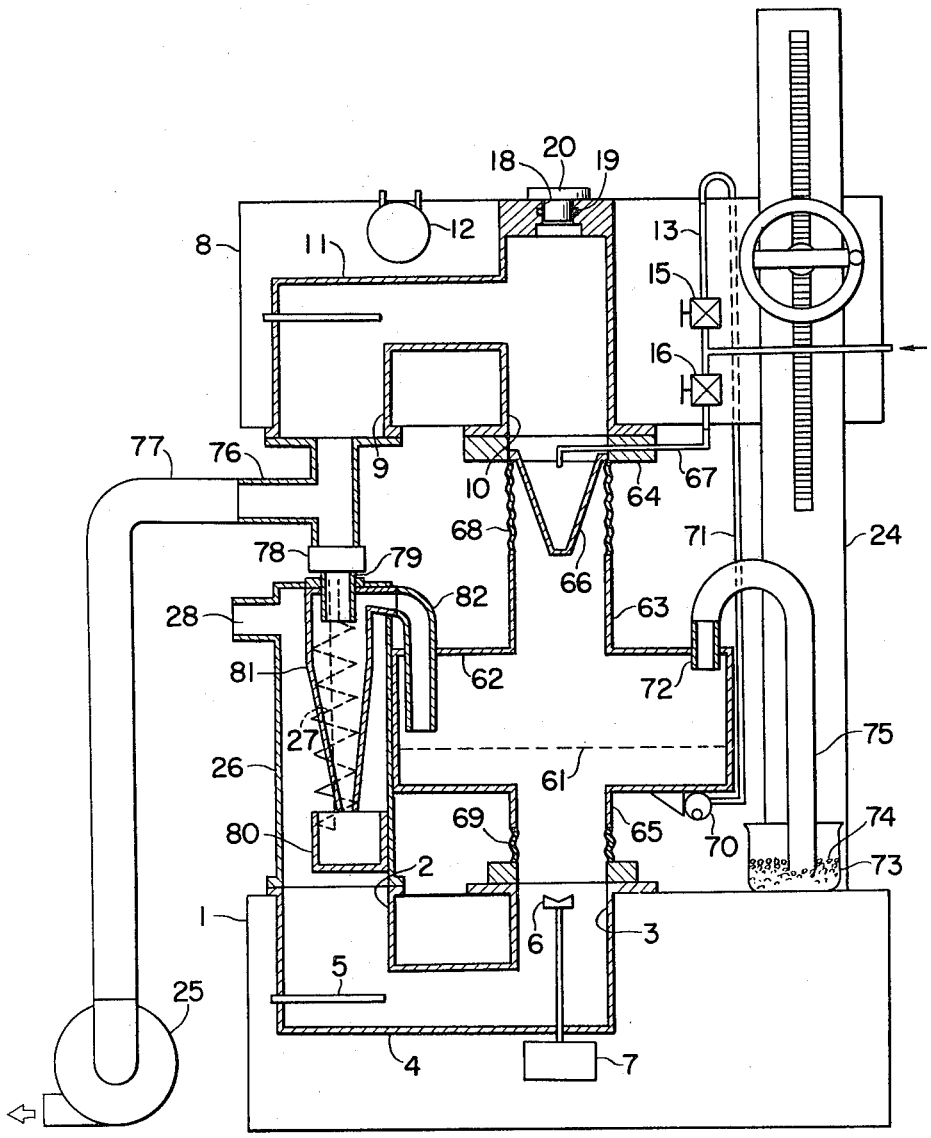

The upper frame 8 also accommodates a small-sized feed pump 12 for pumping samples at the upper portion thereof and a feed pipe 13 for pressurized air at the side portion thereof near the column 24. The feed pipe 13 is provided with an adjusting valve 15 and an electromagnetic valve 16 above and below an inlet pipe 14, respectively. The electromagnetic valve 16 is operated by a separate apparatus. The upper piping 11 is provided with an upper thermosensor 17 on the side of the opening 9 and a through hole 18 for insertion of a nozzle from above the upper frame body into the upper piping 11. The hole 18 is provided with an O ring 19 and is closed by means of a cap 20 when it is not used, as shown in FIG. 4.

The upper frame 8 can be manually moved upwardly and downwardly by means of a lift mechanism supported on the column 24 and including a vertical feed handle 21, a pinion 22 and a rack 23.

An aspirator 25 is provided as a part of the apparatus to be used as described hereinafter. A cylinder 26 provided therewithin with a heater 27 and an opening 28 near one end thereof is of a size such that it can be connected at its other end to one of the openings of the upper and lower pipings 4 and 11. The cylinder 26 and the aspirator 25 are used as common accessories when the powder treatment apparatus is applied to various powder treatments.

Figure 2:
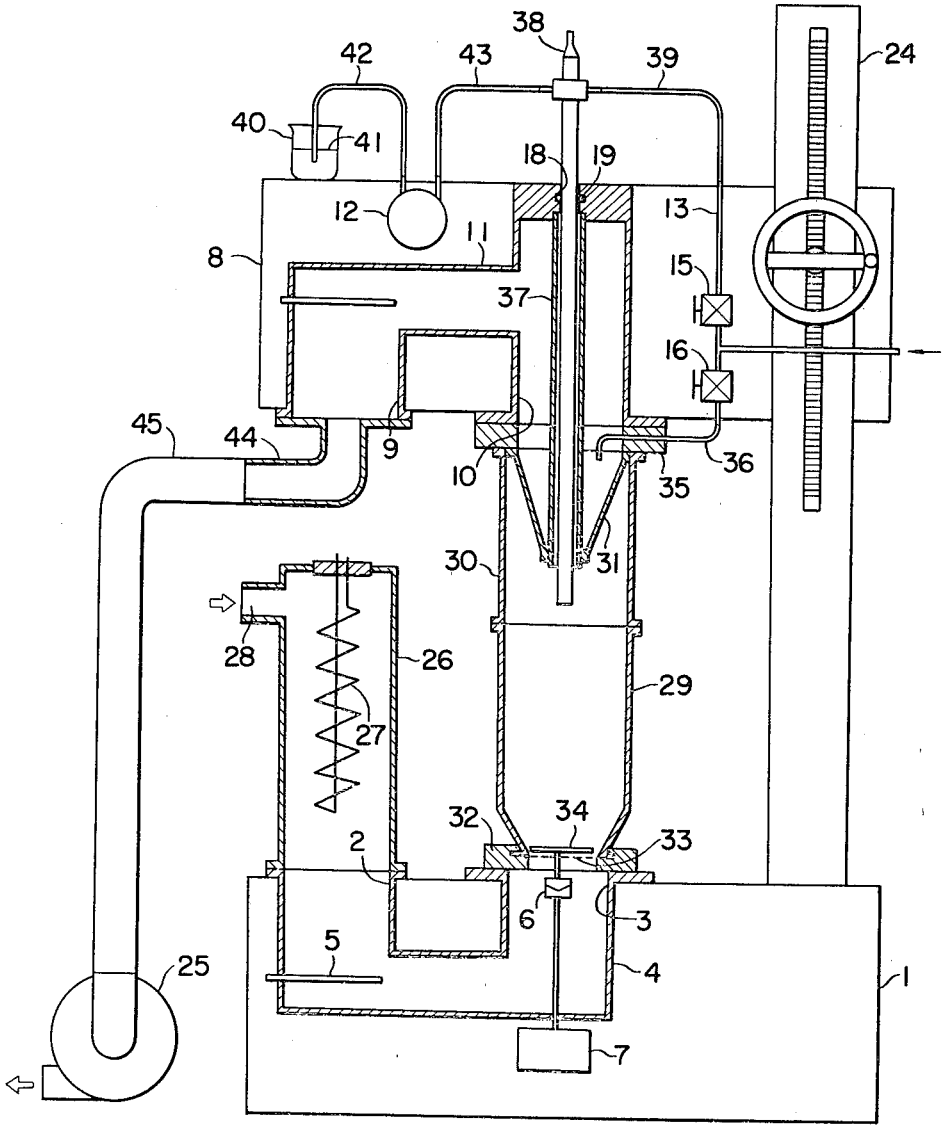
FIGS. 2, 3, and 4 are similar elevations of the basic apparatus shown in FIG. 1 which is adapted to carry out fluidized bed drying and granulation, spray drying, and fluidized bed continuous drying, respectively.
Figure 3:
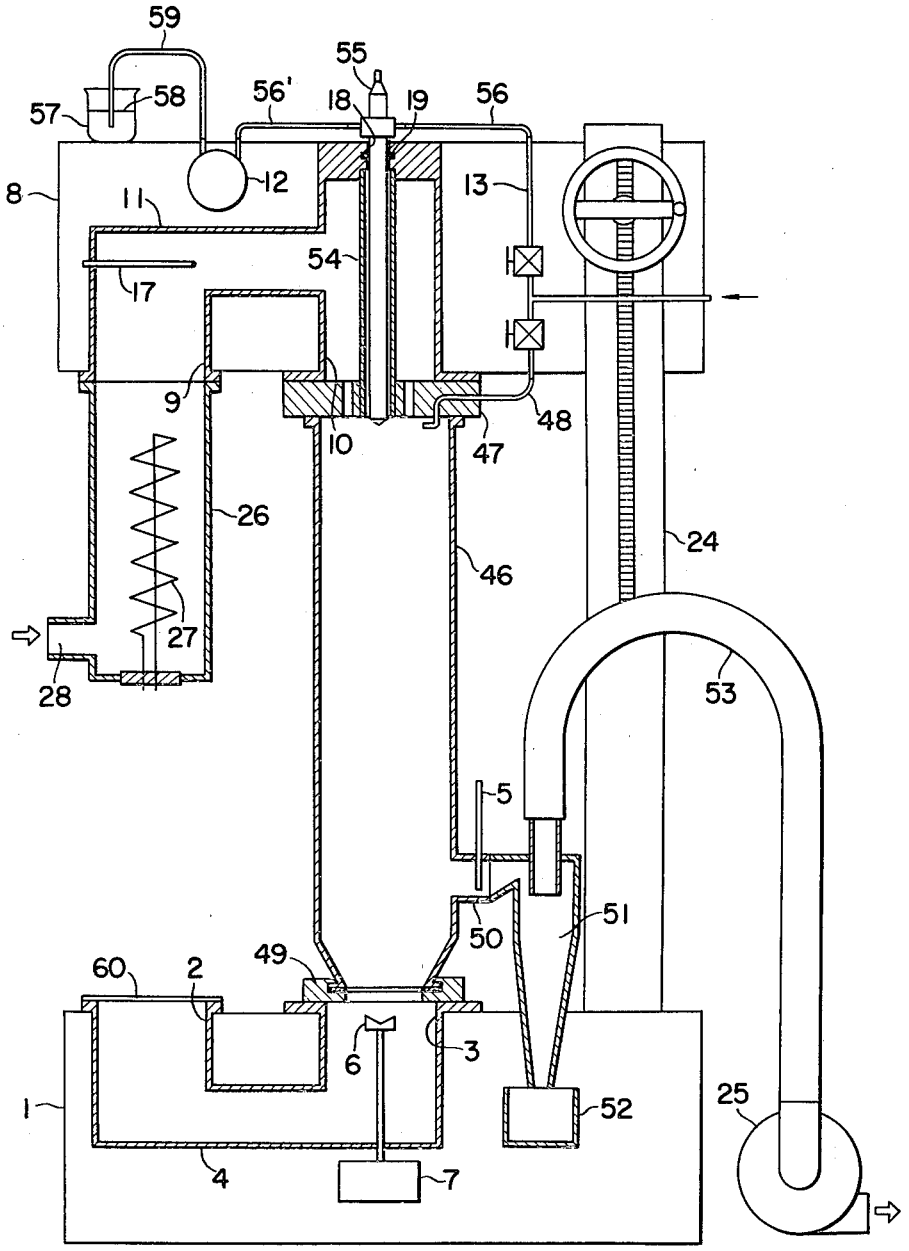

The application of the powder treatment apparatus to various powder treatments will be described in detail with reference to FIGS. 2, 3, and 4.

One embodiment in which the apparatus of the present invention is applied to a fluidized bed drying and granulation operation will be described with reference to FIG. 2. The upper frame 8 is positioned at a suitable height by the lift mechanism on the column 24. Then, two superhard glass cylinders 29 and 30 which are opened at the both ends thereof are coaxially coupled and connected between the opening 3 of the lower piping 4 and the corresponding opening 10 of the upper piping 11. The lower cylinder 29 constitutes a fluidizing chamber in which a fluidized bed is formed, and the upper cylinder 30 constitutes a filter chamber having a filter 31 disposed therein. The lower portion of the fluidizing chamber 29 is of a frustoconical shape having a gradually decreased diameter in the downward direction. The fluidizing chamber 29 is communicatively connected to the opening 3 by means of a fixture 32. Coaxially within the lower cylinder 29 at its lower end, there is provided a grid 33 and a stirring blade 34 driven in rotation by the aforementioned stirring motor clutch 6. On the other hand, the filter chamber 30 is connected at its upper end to the opening 10 of the upper piping 11 via a distributor 35, through which a pipe 36 connected to one end, i.e., the lower end, of the feed pipe 13 for pressurized air of the upper frame 8 is extended so that pressurized air can be supplied into the upper part of the filter 31.

A nozzle guide pipe 37 is passed through the hole 18 of the upper frame 8 and the upper piping 11 into the filter chamber 30. The guide pipe 37 is provided therein with a two-fluid atomizing nozzle 38. A pipe 39 connected to the other end, i.e., the upper end, of the feed pipe 13 for pressurized air is connected to the upper end of the nozzle 38. The feed pump 12 is provided on its suction and delivery sides with pipes 42 and 43 communicating with a binder solution 41 contained in a container 40 and the upper end of the nozzle 38, respectively. A cylinder 26 including a heater 27 installed therein is attached to the opening 2 of the lower piping 4 as in the basic assembly shown in FIG. 1. The aspirator 25 is connected to the opening 9 of the upper piping 11 via a suction hose 45 and a suction pipe 44.

When a wet powder sample is introduced into the fluidizing chamber 29 of the apparatus thus assembled, and the aspirator 25 is operated, air is sucked through the opening 28 of the cylinder 26 and heated by the heater 27. The heated air is passed through the lower piping 4 and injected into the fluidizing chamber 29 via the grid 33. As a result, the sample is suspended in the air to form a fluidized bed wherein the sample is soon dried.

If the powder sample is to be formed into granules, the binder solution 41 contained in the container 40 positioned above the upper frame 8 is fed into the nozzle 38 by means of the pump 12. Then, the binder solution is mixed at the end of the nozzle with pressurized air which is fed into the nozzle 38 via the feed pipe 13 and the pipe 39 after it has been subjected to pressure adjustment by means of the adjusting valve 15. Thereafter, the mixture in atomized state is injected into the powder sample in fluidized state thereby to produce granules.

When the fine particles in the sample are scattered into the chamber 30, they are collected by the filter 31. The collected particles are blown down from the filter 31 by pressurized air periodically ejected through the feed pipe 13 and the pipe 36 via the electromagnetic valve 16 and are returned into the fluidized bed within the chamber 29, where they are dried or granulated. In cases where the fluidized states are not satisfactory and wet powder is to be dried, the motor 7 is operated to rotate the stirring blade 34 above the grid 33, whereby a good fluidized bed is formed, and the drying of the wet particles or granulation of the particles can be effectively carried out.

This type of the apparatus can be used even with a sample of a quantity of the order of from 50 to 300 g. Accordingly, this apparatus is highly suitable for an experiment using an expensive sample and for laboratory scale testing research. The temperature of the hot air and the quantity of the pressurized air or binder solution can be adjusted through detecting means. Also, the position of the nozzle can be adjusted in the upward and downward directions. In addition, both the fluidizing chamber and the filter chamber can be made of a superhard glass for convenience in observing the condition of the fluidized bed and the atomization condition and adjusting these conditions.

Next, one example spray drying by means of the apparatus of the present invention will be described with reference to FIG. 3. A slightly longer cylinder 46 which is opened at the upper end thereof and constitutes a drying chamber is vertically connected between the opening 3 of the lower piping 4 and the opening 10 of the upper piping 11. In this case, the opened upper end of the cylinder 46 is connected to the opening 10 via a distributor 47 which is provided with a pipe 48 extending from one end of the feed pipe 13 to the vicinity of the lower end of the nozzle 55. The closed lower end of the cylinder 46 has a tapering frustoconical shape in which the diameter is gradually reduced and is connected to the opening 3 via a fixture 49. The cylinder 46 is provided with a pipe 50 at its portion near its closed lower end. The pipe 50 is connected to a cyclone 51 and a receiving vessel 52 connected to the lower end of the cyclone 51. The central exhaust tube of the cyclone 51 is connected to the aspirator 25 via a suction hose 53. The pipe 50 is provided with a lower thermosensor 5.

A nozzle guide pipe 54 whose lower end reaches the upper portion of the drying chamber 46 is passed through the upper frame 8 and the hole 18 of the upper piping 11. The nozzle 55, which is a two-fluid atomizing nozzle, is provided within the guide pipe 54. The nozzle 55 is provided near its upper end with pipes 56 and 56' respectively communicating with the feed pipe 13 for pressurized air and the delivery side of the liquid feed pump 12. The pump 12 is provided on its suction side with a pipe 59 communicating with a liquid material 58 to be spray dried which is contained in a container 57.

The opening 2 of the lower piping 4 is closed by a partition board 60, while to the opening 9 of the upper piping 11 is connected to the cylinder 26 having the heater 27 therein.

When the aspirator 25 is operated, air is sucked through the opening 28 of the cylinder 26 and heated by the heater 27. The heated air is adjusted in the distributor 47 and is sucked into the drying chamber 46. On the one hand, the liquid material 58 to be spray-dried is fed into the two fluid nozzle 55 by means of the pump 12 and mixed with pressurized air at the lower end of the nozzle. The mixture is sprayed into the drying chamber 46. Upon contact with the heated air, the major proportion of the water contained in the mixture is instantaneously evaporated to produce fine granules of the material. The dried material in the form of fine granules is sucked into the cyclone 51 while being subjected to further drying and then collected in the receiving vessel 52. The evaporated water is discharged from the aspirator 25.

In the case where a large amount of the liquid material sample is adhering to the end of the nozzle, the electromagnetic valve 16 can be opened to blow pressurized air onto the end of the nozzle through the distributor 47 via the pipe 48 thereby to remove the deposited material therefrom. The temperature condition during the operation can be monitored by the lower thermosensor 5 and the upper thermosensor 17.

When the above described assembly of the apparatus is used, even a minute quantity (of the order of 0.5 g) of an expensive sample such as drugs can be effectively spray-dried without the use of a large-sized apparatus required for the conventional technique. Of course, the above described spray drying method of the present invention requires neither pre-treatment nor post-treatment. In accordance with the above described method, a mere instantaneous heating of the liquid material can produce uniform, fine particles without any substantial deterioration or contamination of the material.

In addition, the case in which the apparatus of the present invention is applied to fluidized-bed continuous drying will now be described with reference to FIG. 4. While the fluidized bed drying described with reference to FIG. 2 is carried out in a batchwise manner, the fluidized bed drying by means of the apparatus in the form illustrated in FIG. 4 is carried out in a continuous manner. In this case, a horizontal fluidizing chamber 62 having a grid 61 therein is provided between the opening 3 of the lower piping 4 and the opening 10 of the upper piping 11 in such a manner that a cylinder portion 63 extending upwardly from the center of the chamber 62 is connected to the opening 10 of the upper piping 11 via a distributor 64, and a cylinder portion 65 extending downwardly from the center of the chamber 62 is connected to the opening 3 of the lower piping 4.

The upper end of the upper cylinder 63 is provided with a filter 66. The distributor 64 is provided with a pipe 67 whose inner end extends toward the filter 66, and which is connected at its other end to the feed pipe 13 for pressurized air. The upper and lower ends 68 and 69 of the upper and lower cylinder portions 63 and 65 are made of flexibly expandable material, so that the chamber 62 can be vibrated by means of a vibrator 70 provided below the chamber 62. The vibrator 70 is provided with a pipe 71 extending to and connected to the adjusting valve 15 of the feed pipe 13 for pressurized air. The chamber 62 is provided at the right upper portion with an opening 72 to which one end of a sample guide pipe 75 extending at its other end into a sample 74 contained in a container 73 is connected.

The opening 9 of the upper piping 11 is connected to one end of a Tee-shaped suction distributing pipe 76 whose ends are open. Another open end of the suction distributing pipe 76 is connected to the aspirator 25 via a suction hose 77. The opening 2 of the lower piping 4 is provided with the cylinder 26 having the heater 27 installed therein. The third open end of the suction distributing pipe 76 is connected to the central exhaust tube 79 of a cyclone 81 including a receiving vessel 80 at the bottom thereof via a fixture 78. The cyclone 81 is provided at its upper end with an inlet pipe 82 extending into the upper space of the horizontal fluidizing chamber 62.

Then, when the aspirator 25 is operated, pressure loss is developed in the filter 66, the cyclone 81 and the grid 61, which causes pressure differences within the apparatus. Because of the differential pressure between the upper space of the chamber 62 above the grid 61 and the container 73, the sample 74 contained in the container 73 is sucked into the chamber 62 via the pipe 75. On the other hand, air is sucked into the cylinder 26 through the opening 28 and the air is heated by the heater 27. The hot air is then ejected at a high speed through the grid 61 to provide a fluidized bed over the grid 61. Because of the differential pressure prevailing from the right end to the left end of the chamber 62 over the grid 61 and the vibration produced by the vibrator 70, the sample 74 sucked into the chamber 62 migrates from the right end to the left end while fluidizing on the grid 61. During this migration, the sample is dried by the hot air blown up from beneath the grid 61. Furthermore, because of the differential pressure between the upper space of the chamber 62 above the grid 61 and the cyclone 81, the fluidized bed dried sample is sucked into the cyclone 81 and then collected into the receiving vessel 80. By feeding fresh sample 74 into the container 73, a continuous fluidized bed dry operation can be effected.

The apparatus thus constructed makes it possible to dry a wet powder sample continuously and effectively by utilizing the differential pressures produced in various places within the apparatus.

The compact basic apparatus for treating powders according to the present invention can be easily applied to various powder treatments including fluidized bed drying and granulation, spray drying and continuous fluidized bed drying by first adjusting the lift to a desired height, providing the required accessories, such as chamber members and cyclone, between the openings of the upper and lower pipings and connecting a feed pipe for pressurized air, a feed pump, an aspirator and the like to the required positions. Attaching and detaching of these accessories, connecting of these accessories therebetween and exchanging and adjusting of these accessories can be simply carried out. Accordingly, when various powder treatments are carried out on a small scale, for example, in a laboratory, the basic apparatus of the present invention can be conveniently utilized without causing increase in the space and cost required for installing the apparatus. Therefore, the basic apparatus of the present invention is advantageous from an economical point of view.

What is claimed is:

1. A multipurpose basic apparatus for treating powders which is applicable to various powder treatments including spray drying, fluidized bed drying and granulation and fluidized bed continuous drying, which apparatus comprises:

a lower frame provided with a lower piping having two openings facing upward;

an upper frame provided with an upper piping with two openings facing downward and respectively positioned in coaxially aligned relation to the two openings of the lower piping;

a feed pump for a liquid provided on said upper frame;

a feed pipe for pressurized air provided in one of said two openings in said upper frame;

a lift mechanism for moving the upper frame up and down to provide a variable and settable spacing between said upper and lower frames;

at least one material treatment chamber being connected between and in fluid communication with one opening of the lower piping and the corresponding coaxially aligned opening of the upper piping;

at least one air modifying chamber being connected between and in fluid communication with at least one of the other openings of the upper and lower pipings; and an air circulating means for creating an air flow in said air modifying chamber.

2. An apparatus as claimed in claim 1 wherein said material treatment chamber comprises a filter means and a fluidizing means provided in series in said treatment chamber, said air modifying chamber comprises a heater provided in said air modifying chamber, said feed pipe for pressurized air supplies air to said fluidizing means and said feed pump supplies said liquid to said fluidizing means.

3. An apparatus as claimed in claim 1 wherein said material treatment chamber comprises a spray drying chamber, said air modifying chamber comprises a heater and said feed pump and feed pipe for pressurized air are coupled to said spray drying chamber and further comprising a cyclone coupled to an outlet of said spray drying chamber.

4. An apparatus as claimed in claim 1 wherein said material treatment chamber comprises a horizontal fluidizing chamber and said air modifying chamber comprises a heater and further comprising a cyclone coupled to an outlet pipe of said horizontal fluidizing chamber and one of said other openings in said upper pipings.

* * * * *